US005154377A

United States Patent [19]

Suk

[11] Patent Number: 5,154,377

[45] Date of Patent: Oct. 13, 1992

[54] GOLF BAG STAND

[76] Inventor: Young J. Suk, 34 Garvies Point Rd., Glen Cove, N.Y. 11542

[21] Appl. No.: 820,519

[22] Filed: Jan. 15, 1992

[51] Int. Cl.[5] ..... A63B 55/00

[52] U.S. Cl. ..... 248/96; 206/315.7

[58] Field of Search ..... 248/96, 171, 688, 297.2; 206/315.3, 315.7

[56] References Cited

U.S. PATENT DOCUMENTS

| | | | |
|---|---|---|---|
| 846,552 | 3/1907 | Collins et al. | 248/688 X |
| 1,135,464 | 4/1915 | Parnall | 248/96 |
| 1,181,007 | 4/1916 | Honneberg | 248/96 |
| 1,924,182 | 8/1933 | Fritz | 206/315.7 |
| 4,620,682 | 11/1986 | Yim | 248/96 |
| 4,815,734 | 3/1989 | Verhulst | 248/297.2 X |
| 5,036,974 | 8/1991 | Ross, Jr. | 206/315.7 |

FOREIGN PATENT DOCUMENTS

| | | | |
|---|---|---|---|
| 1138217 | 12/1968 | United Kingdom | 248/96 |

*Primary Examiner*—David L. Talbott

[57] ABSTRACT

In a golf bag support stand of the type in which descending sliding movement of a slide member is required incident to using the support stand, the movement of the slide member along a track which uses two parallel grooves on opposite sides of an intermediate raised section and a conforming shape in the slide member which, as a result, obviates deviation of the slide member from a vertical path and any binding or other adverse consequence during the sliding movement thereof.

1 Claim, 2 Drawing Sheets

GOLF BAG STAND

The present invention relates generally to improvements for a golf bag stand, and more particularly to improvements for a popularized aptly characterized two-position golf bag stand in which the golfer has the option of either using or bypassing the use of the leg mechanism of the stand, depending on an operative position of the leg mechanism. The option noted requires movement of a slide, and according to the present invention significant structural features are embodied in the stand to control the tracking of the slide during its movement, to correspondingly significantly enhance the use of the golf bag stand.

EXAMPLE OF THE PRIOR ART

It is already known in the prior art, as exemplified by U.S. Pat. No. 4,620,682 issued to Byung D. Yim on Nov. 4, 1986, to provide a golf bag stand formed as a tripod arrangement of the golf bag and two spread apart angularly oriented legs. In the Yim patent, the leg mechanism is adapted to be moved from an upper to a lower operative position, so that contact with the ground actuates the legs from their normally closed positions against the bag into their open bag-supporting positions. When the support provided by the legs is not needed, as when the golf bag is carried on a golf cart, the leg mechanism is raised to its upper position.

While the popularity of the prior art two-position golf bag stand, providing the option of using or bypassing the use of the legs, is significant, the sliding or shifting movement of the leg mechanism required for the optional operational mode contributes to malfunctioning heretofore not satisfactorily obviated. In Yim, for example, a leg mechanism slide member slides along a vertically oriented shaft or rod and has the legs connected to extend from opposite sides thereof and uses a threaded member to engage the rod to hold its positions of movement therealong. The contact of the threaded member directly against the rod and the forces transmitted through the legs and correspondingly imparted against the opposite ends of the slide member, together with normal abuse unavoidable in the use of the golf bag and other factors, contribute to malfunctioning, particularly that manifested as angular deflection in the slide member and, thus, in difficulty in its partaking of unimpeded sliding movement along the rod between its upper and lower operative positions.

Broadly, it is an object of the present invention to provide a tripod-type golf bag stand with the described leg use or non-use option, overcoming the foregoing and other shortcomings of the prior art.

More particularly, it is an object to have the leg-opening slide member track along a raised rectangular configuration and through two adjacent parallel path-defining grooves, to thereby maintain sliding movement in a substantially vertical direction with minimum angular deflection. The two operative positions of movement are established by contact with the rectangular configuration without adverse effect, and the within improvements provide other noteworthy benefits, all as will be better understood from the detailed description which follows.

The description of the invention which follows, together with the accompanying drawings, should not be construed as limiting the invention to the example shown and described, because those skilled in the art to which this invention appertains will be able to devise other forms thereof within the ambit of the appended claims.

Figure 6:
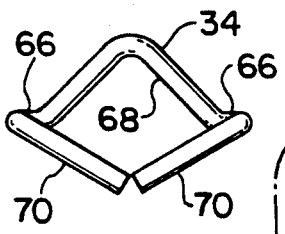
FIG. 6 is a detailed view taken along line 6—6 of FIG. 1 of the vertically moveable lower end of the leg actuating member.
Figure 1:
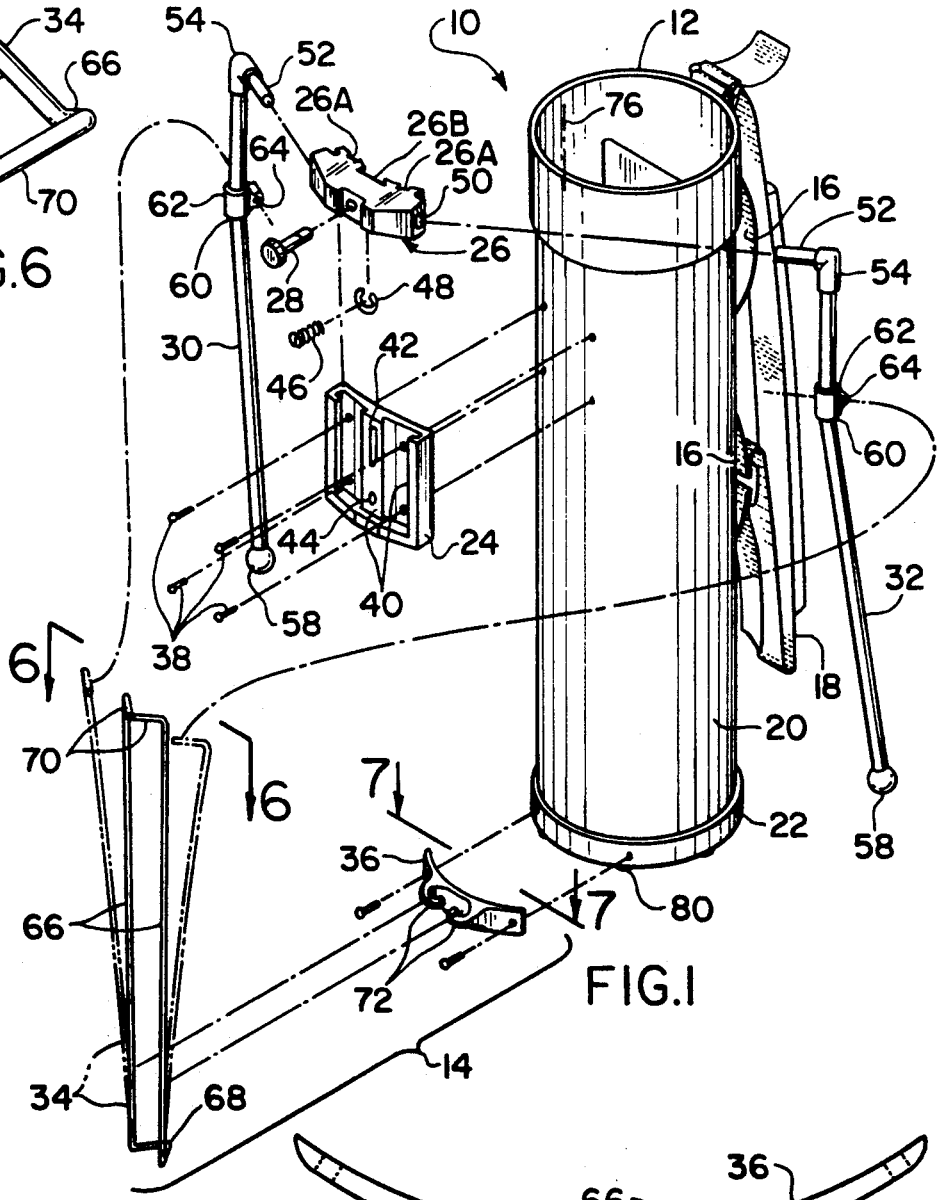
FIG. 1 is an exploded perspective view of the within inventive two-position golf bag stand showing the components thereof in unassembled relation.
Figure 3:
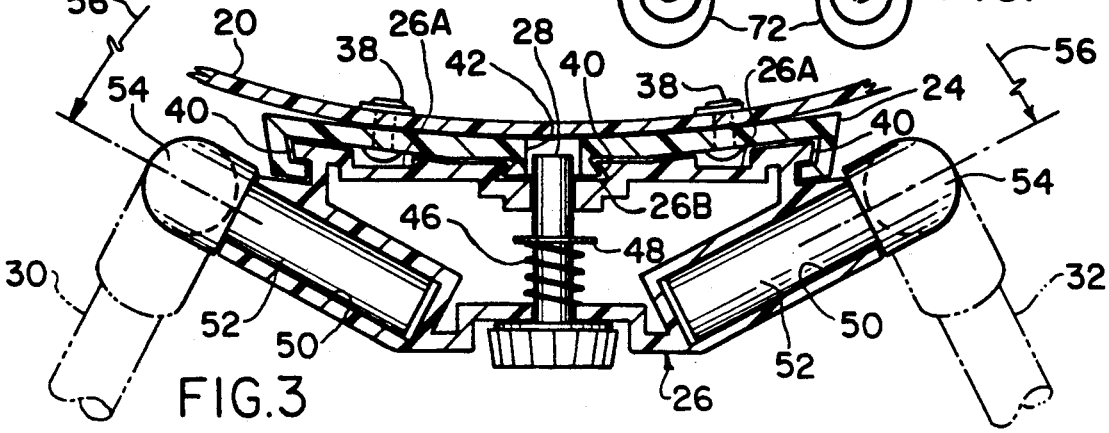
FIG. 3 is an enlarged scale cross sectional view taken along line 3—3 of FIG. 2.
Figure 5:
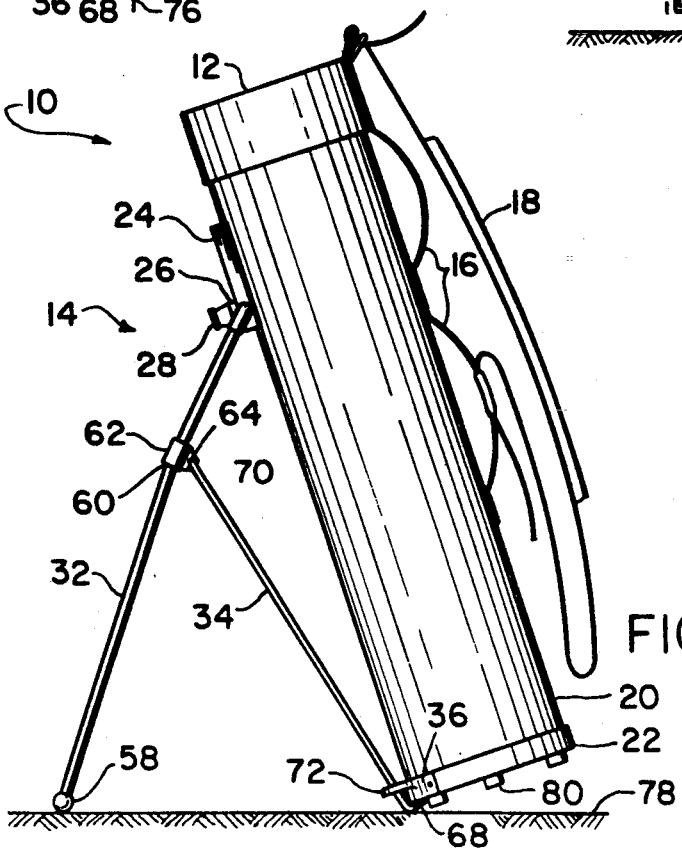
FIG. 5 is a view similar to FIG. 4 showing the stand in its bag-supporting position.

As perhaps is best understood from FIG. 1, the within inventive stand of the present invention, generally designated 10, is assembled to a conventional golf bag 12 to provide, during golfing use of the bag, an automatically actuated leg support mechanism 14, which can be manually adjusted between upper and lower operative positions, to provide the golfer with the option, when in its upper position, of bypassing use of the legs, and, in its lower position, with using the legs in the manner shown in FIGS. 3 and 5, to form a tripod arrangement or support stand which holds the golf bag 12 in an erect position for the convenience of the golfer, all as will be explained in greater detail as the description proceeds.

Golf bag 12 is fitted with the usual hand grips 16 and adjustable padded carrying strap 18. Diametrically opposite the handles 16 and strap 18 there is allotted space adjacent the top of the bag 12 for the mounting of the leg mechanism 14. The outfitting of the bag 12 includes customary zippered bags and pouches (not shown) which are stitched about the remaining surface of the side wall 20 of bag 12. Wall 20 has a bottom, pan-like, closure member 22 rivetted, or otherwise secured thereto.

Figure 2:
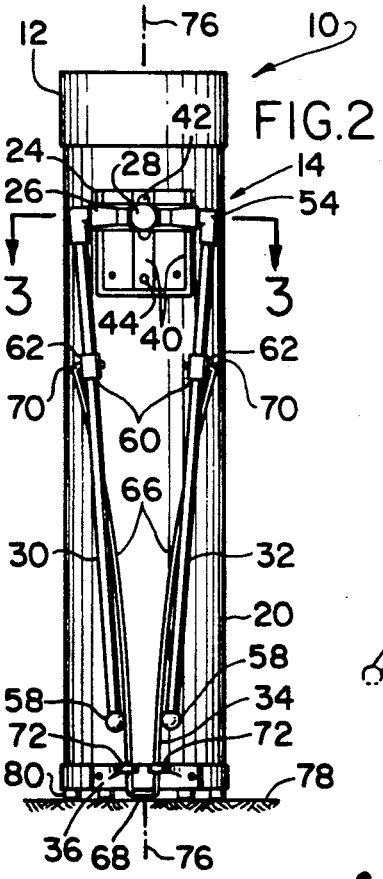
FIG. 2 is a front elevational view of the fully assembled stand with the leg mechanism thereof in its upper operative position bypassing use of the legs.
Figure 4:
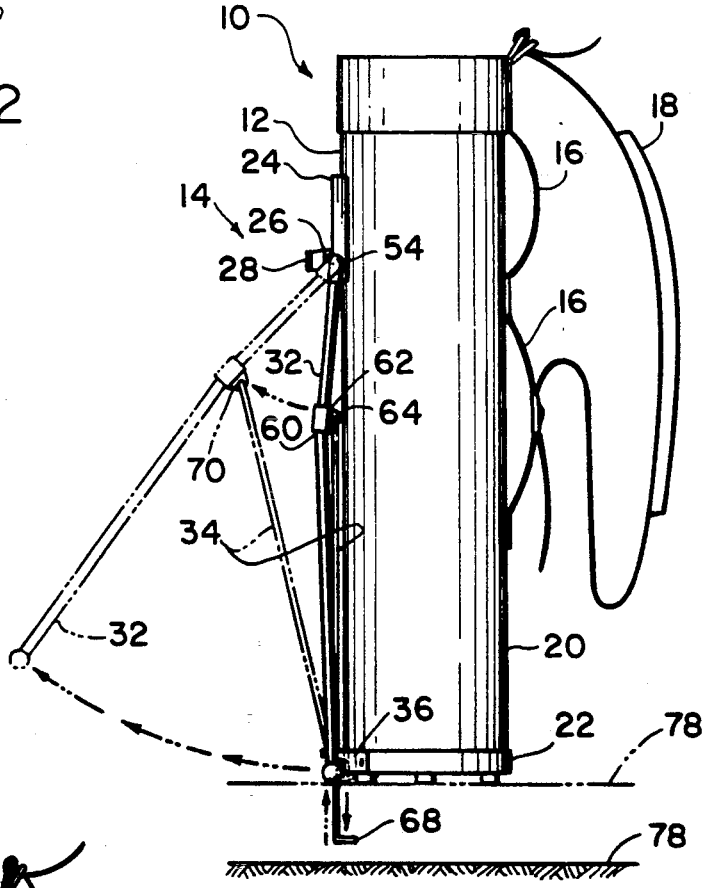
FIG. 4 is a right side elevational view of the stand with the leg mechanism in its lower operative position, and illustrating the opening leg movement from its closed position against the golf bag shown in full line perspective into its bag-supporting position shown in phantom line perspective.

Continuing with the description with specific reference to FIG. 1, it will be noted that leg mechanism 14 is comprised of a base plate 24, which functionally is a slide bracket in that it is the component upon which a slide of the leg mechanism tracks, a slide 26 cooperating with the slide bracket or member 24, which is part of the leg stand mechanism, and, in fact, is the component required to assume the upper and lower operative positions to provide respectively the non-use and leg use operational modes, a lock pin 28, a left leg assembly 30, a right leg assembly 32, a dual cantilever spring 34 and a spring bearing guide 36. Base plate 24 is appropriately slightly curved to facilitate its being fitted to a correspondingly curved bag support surface 20 to which it is attached by an array of rivets 38. In this location, base plate or slide bracket 24 advantageously presents to the slide 26 a dovetailed track and guide means 40 for maintaining substantially vertical movement of slide 26 while partaking of sliding movement between an upper elongated slot 42 coincident with an upper operative slide position, and a lower detent hole 44 coincident with a lower operative slide position. In the upper operative position of slide 26, as shown in FIG. 2, the use of the legs is bypassed, while in the lower operative position, as shown in FIG. 4, the legs are actuated to provide support for the bag 12 as intended and shown in FIG. 5. To hold slide 26 in a selected one of its two possible positions, slide 26 is designed to receive lock pin 28 for cooperative engagement within either hole 44 or elongated slot 42 in plate 24. A biasing spring 46 and a C-ring 48 are used to urge pin 28 to engage opening 42 or 44. Additionally, slide 26 is provided with right and left end openings 50 to receive the inward extending axial ends 52 of right angle fittings 54 on the upper ends of legs 30, 32. Openings 50 are arranged to be at an obtuse angle 56 of approximately 120°, so that legs 30, 32 will take a radial orientation in their extended position as seen in phantom perspective in FIG. 3. On the lower ends of legs 30, 32 a plastic ball or foot 58 is press fitted thereon. Legs 30, 32 themselves are preferably made of ½" diameter lightweight metal tubing. At a point 60, about ¼ their length from the upper end, legs 30, 32 are provided with an angular crook or knee. Also at point 60, a ferrule 62 is riveted or otherwise fastened to each of the legs 30, 32. Ferrules 62 each internally bound a through bore 64. At assembly to receive legs 30, 32, the ferrules 62 are oriented to align with respective bores 64 that are parallel to horizontally oriented upper leg ends 52 projected through fittings 54, and are also aligned with upper ends 70 on spring 34, the significance of which will soon be apparent.

Spring member 34, made of heavy gauge spring wire, is formed as a pair of essentially parallel cantilevers 66 about a foot 68. The upper ends 70 of cantilevers 66 are additionally formed at right angles to the shaft 66 and at an appropriate angle in a horizontal plane to correspondingly align with bores 64 to permit the assembly on the legs of the leg ferrules 62.

Figure 7:
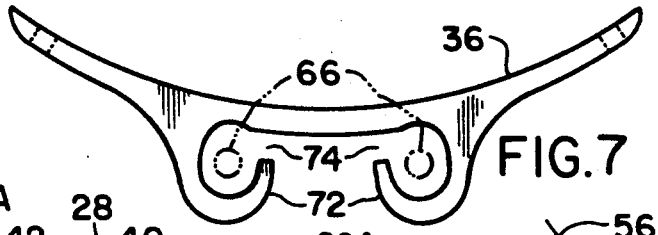
FIG. 7 is a detailed view taken along line 7—7 of a guide cooperating with the leg actuating member during the vertical movement thereof.

A spring bearing guide 36, preferably of plastic construction material is, as best seen in FIGS. 1 and 7, riveted to, or optionally molded as part of closure member 22, to the bottom end of wall 20. At assembly, cantilevers 66 are snapped within a pair of open guide members 72 formed with oversized openings 74 to facilitate this assembly.

When all components of the within leg support mechanism 14 shown in FIG. 1 are assembled symmetrically about a vertical center line 76 on golf bag 12, the resulting construction appears as shown in FIG. 2.

It is appropriate at this point in the description to note that cantilevers 66 are spread apart a considerable distance, and thus provide a lateral force against ferrules 62 which, in turn biases the inturned ends 52 on legs 30, 32 into firm contact with the surfaces bounding the bearing socket openings 50 in slide 26. Mechanism 14 as shown in FIG. 2 will be understood to be in its passive mode wherein pin 28 is engaged within slot 42 which consequently holds slide 26 and, thus, the legs 30, 32 and spring 34, including the foot 68 thereon, in a raised position unable to make contact with the ground. When bag 12 is thus standing vertically on the ground or a surface 28, foot 68 is held within a space provided by standoff extensions 80 on the bottom surface of closure member 22. In this passive mode, device 10 can be placed on a golf cart, or otherwise used without leg supports and the space that the open leg support would require.

To bring leg mechanism 14 into its active mode, device 10 is lifted above surface 78, as shown in FIG. 4 in solid line perspective, while pin 28 is retracted from slot 42 and relocated in detent hole 44, thus lowering slide 26 and extending foot 68 beneath the bottom of the bag 12. In this leg mechanism condition bag 12 is readily portable between golf shots with legs 30, 32, if desired, in their non-extended position. When device 10 is placed on the ground or support surface 78, shown in phantom perspective in FIG. 4, the weight of bag 12 causes rod like cantilevers 66 to extend both legs 30, 32, much in the manner in which a knee brace pushes its cooperating respective spoke away from the hub shaft upon opening an umbrella. It is to be noted that, when legs 30, 32 are fully extended, the upper ends 70 of cantilevers 66 are spread even further apart than when legs 30, 32 are in their retracted position. This arrangement provides the necessary bias to return legs 30, 32 to their retracted position when bag 10 is again lifted from surface 78. When the legs are extended, the user then places device 10 into the position shown in FIG. 5 wherein ball feet 58 on legs 30, 32 and foot 68 on spring 34 contact surface 78 forming a three-point or tripod stand that is stable, and holds the bag 12 erect to enable the golfer to conveniently remove a selected golf club.

From the foregoing description it should be readily understood that, in the open stand position of FIG. 5 of the bag and its golf club contents, as a function of the supported weight that there is transmitted longitudinally of the legs 30, 32 a force which is imparted or applied to the opposite ends of slide 26, which has a tendency to deflect the slide 26 from a desired horizontally oriented position. This tendency or torque force over a period of use, in conjunction with other factors, ultimately adversely effects the tracking of slide 26 between its upper (FIG. 2) and lower (FIG. 4) operative positions. Thus, underlying the present invention are construction improvements in the slide bracket 24 and slide 26 to obviate this tracking problem.

More particularly, and as may be readily noted in the enlarged scale cross sectional view of FIG. 3, bracket 24 for the slide 26 has a curved rear surface conforming to the curved support surface of bag 12 to facilitate the rivet attachments 38 thereto. Slide bracket 24 in its mounted position presents forwardly projected opposite sides 40, and in a central location, a raised rectangular configuration 40. Thus, between each opposite side of bracket 24 and the facing side of the medial rectangular configuration there are formed two parallel vertically oriented tracks, designated 40 in FIGS. 1 and 4.

Slide 26 has spaced apart projections 26A which align with, and in practice project into, the tracks 40 of bracket 26, and a medial connecting or spanning portion 26B coextensive with the spacing of the projections which is sized and shaped to be placed in covering relation over the slide bracket medial section 40. The interfitting of the rectangular shape bounded by the projections 26A and surface 26B over the raised medial section 40 of slide bracket 24 obviates any angular deflection tendency in the slide 26, and thus contributes to unimpeded sliding movement of slide 26.

While the within two-position golf bag stand, herein shown and disclosed in detail, is fully capable of attaining the objectives and providing the advantages hereinbefore stated, it is to be understood that it is merely illustrative of the presently preferred embodiment of the invention, and that no limitations are intended to the detail of construction or design herein shown other than as defined in the appended claims.

What is claimed is:

1. In a golf bag stand of the type consisting of a tripod arrangement of said golf bag and two cooperating golf bag-supporting legs actuated from a normally closed position against said golf bag into an open golf bag-supporting position in response to the sliding movement of a leg-opening slide member from an upper to a lower sliding position of movement vertically along said golf bag, the improved tracking means for the partaking of said sliding movement of said leg-opening slide member comprising a slide bracket of a curved shape adapted to fit against a correspondingly curved shaped surface adjacent an upper end of said golf bag, said slide bracket having opposite sides and a raised rectangular medial section extending laterally therefrom to bound a detent pin-receiving chamber therebeneath and in the clearances between each said opposite side and a facing side of said rectangular medial section two parallel vertically oriented tracks, and serving as said leg-opening slide member a slide operatively disposed for sliding movement on said slide bracket, said slide having two opposite side projections shaped and sized to extend into a cooperating one of each said vertically oriented track and having a connecting medial portion in covering relation over said slide bracket rectangular medial section, and a cooperating interconnecting detent pin on said slide medial portion and upper and lower access openings into said detent pin-receiving chamber beneath said underlying slide bracket rectangular medial section for selectively holding said upper and lower positions of sliding movement of said slide relative to said slide bracket, whereby the tracking of said slide along said slide bracket is maintained substantially in a vertical direction with a minimum of angular deflection therefrom to contribute to unimpeded sliding movement of said slide.

* * * * *